United States Patent [19]

Thellmann

[11] 3,963,485

[45] June 15, 1976

[54] METHOD OF PRODUCING SINTERED TITANIUM BASE ARTICLES

[75] Inventor: Edward Louis Thellmann, Walton Hills, Ohio

[73] Assignee: Gould Inc., Rolling Meadows, Ill.

[22] Filed: July 5, 1973

[21] Appl. No.: 376,393

Related U.S. Application Data

[63] Continuation of Ser. No. 249,193, May 1, 1972, abandoned.

[52] U.S. Cl. ..... 75/212; 75/225; 264/111

[51] Int. Cl.[2] ..... B22F 1/02

[58] Field of Search ..... 75/212, 225; 264/111; 148/11.5

[56] References Cited

UNITED STATES PATENTS

| | | | |
|---|---|---|---|
| 2,227,177 | 12/1940 | Berghaus et al. | 75/225 |
| 3,169,085 | 2/1965 | Newman | 148/11.5 |
| 3,310,400 | 3/1967 | Alexander et al. | 75/212 |
| 3,649,374 | 3/1972 | Chalk | 148/11.5 |

*Primary Examiner*—Benjamin R. Padgett
*Assistant Examiner*—R. E. Schafer
*Attorney, Agent, or Firm*—Edward E. Sachs

[57] ABSTRACT

A method of producing a high strength, highly ductile titanium base article is provided which comprises coating pre-alloyed metal particles with an iron containing compound which is capable of being converted to elemental iron particles, converting this iron containing compound to elemental iron particles, mixing the iron particles and pre-alloyed metal particles with titanium base particles, forming this mixture of particles into the desired article, heating the formed article under vacuum conditions to a temperature sufficient to cause the constituent particles of the article to become diffused together, and cooling the article to produce a sintered titanium base article.

15 Claims, No Drawings

METHOD OF PRODUCING SINTERED TITANIUM BASE ARTICLES

This is a continuation, of application Ser. No. 249,193, filed May 1, 1972, now abandoned. BACKGROUND OF THE INVENTION 1. Field of the Invention This invention relates to a method of producing a sintered titanium base article which is characterized by its high density and high ductility. In particular, this invention concerns a method of producing sintered titanium base articles by coating pre-alloyed metal particles with an iron containing compound which is capable of yielding elemental iron particles, converting the iron containing compound to elemental iron particles, mixing these particles with titanium base particles, forming this mixture into an article of the desired configuration, heating this article under vacuum conditions to a temperature sufficient to cause the constituent particles of the article to diffuse together, and cooling the resultant article to produce a sintered article.

Broadly speaking, articles produced according to the teachings of the instant invention exhibit an apparent density in excess of 96 per cent of their theoretical density and good ductility. Articles so produced comprise from about 0.1 to about 0.3 weight per cent iron plus in excess of 50 weight per cent titanium. In the preferred practice of the invention, articles are produced which consist of about 6 weight per cent aluminum, about 4 weight per cent vanadium, from about 0.1 to about 0.3 weight per cent iron, with the remainder being titanium plus incidental impurities.

2. Description of the Prior Art

Titanium is a metal which has been enjoying an increasing amount of usage in industry due, in the main, to its unique properties such as corrosion resistance, high strength and relatively low density. Much of this usage has been in the form of articles fabricated from sheet or bar stock. In the process of fabricating such titanium base articles much scrap is generated and, accordingly, the cost of producing the desired article is thereby increased.

One method of avoiding the generation of such scrap is to fashion the desired article from titanium base powders by powder metallurgy techniques. While this technique for forming titanium articles avoids the generation of huge amounts of unusable scrap, articles produced by sintering formed shapes and configurations consisting essentially of pure titanium generally exhibit low strength and poor ductility. In this regard, many of the problems associated with low strength can be overcome by alloying titanium with various other metals, such as vanadium, aluminum, tin and mixtures thereof; however, this alloying does little, if anything, to increase the ductility of the resultant article.

In general, it may be summarized that presently known techniques for forming titanium base articles either generate excessive amounts of scrap or do not result in an article having a sufficient degree of ductility and/or adequate tensile strength characteristics.

The instant invention assists in overcoming the above set forth problems by providing a means of producing a sintered titanium base article which is characterized by its high tensile strength and good ductility.

SUMMARY OF THE INVENTION

Very briefly, the present invention is accomplished by a method which comprises coating pre-alloyed metal particles with an iron containing compound which is capable of yielding elemental iron particles, converting the iron containing compound to elemental iron particles, mixing the resultant particles with titanium base particles, forming this mixture into an article having the desired configuration, heating the formed article under vacuum conditions to a temperature which is sufficient to cause the constituent particles of the article to diffuse together, and cooling the article to produce a sintered titanium base article.

As used herein the term "pre-alloyed metal" shall mean an alloy composition which when alloyed with the titanium base particles does not interfere with the operation of the invention. Preferrably, this alloy is selected from the group consisting of aluminum-vanadium alloys, aluminum-tin alloys and mixtures thereof.

In addition, used herein, the term "titanium base" shall mean a material which consists of at least 50 but up to 100 weight per cent of titanium, with the remaining portion of the article being composed of a metal which does not deleteriously react with titanium or iron.

In another aspect of the invention, high density, highly ductile titanium base articles can be produced by a method which comprises coating carrier metal particles with an iron containing compound which is capable of yielding elemental iron particles, mixing the coated carrier metal particles with titanium base particles, forming this mixture into an article having the desired configuration, heating this article under vacuum conditions to a temperature sufficient to cause the iron containing compound to yield elemental iron particles and the constituent materials of the article to diffuse together, and cooling the resultant sintered titanium base article.

As used herein the term "carrier metal particles" shall mean metal particles which are to be added to or alloyed with the titanium base particles in the formation of the resultant sintered, titanium base article. In the preferred practice of the invention these particles can be composed of titanium or alloys of aluminum and vanadium or aluminum and tin, or mixtures thereof.

In the practice of the invention, the iron containing compound can be deposited on the carrier metal particles or on the particles of the pre-alloyed metal, by various techniques. However, it usually is preferred to accomplish this procedure by coating the selected particles with an aqueous solution of an iron containing compound, such as an aqueous solution of ferrous chloride.

Various iron containing compounds may be employed for this purpose with the main criteria being that a given compound does not deleteriously react with the particles on which it is deposited, and that it yields an iron sintering aid, preferrably in the form of finely divided elemental iron particles.

By utilizing the teachings of the instant invention, it is possible to produce a sintered titanium base article which is characterized by its high strength, high density and exceptional ductility.

It is therefore the primary object of the invention to provide a method of producing such high strength, high density ductile titanium base articles.

Other objects and the means of accomplishing them will be readily apparent to those skilled in the art from a reading of the herein set forth description and claims.

Description of the Preferred Embodiments of the Invention

In one embodiment of the invention, carrier metal particles composed of essential pure titanium are coated with an iron containing compound which is capable of yielding iron particles during the diffusion procedure.

In this embodiment, it is preferred to use an aqueous solution of ferrous chloride as the means of coating the carrier metal particles with an iron containing compound which is capable of yielding elemental iron particles. However, it should be noted that other iron containing compounds such as ferric chloride may also be used in the practice of the instant invention.

The basic requirement for selecting the proper iron containing compound is that it is capable of yielding an iron material which aids in the activated sintering of the titanium base particles. This material is preferrably in the form of finely divided iron particles, however it may be in the form of an iron-titanium compound formed during the diffusion procedure.

A specific example of the practice of the invention is set forth in Example I below.

Example I

A ductile titanium base article is produced as follows:

a. Approximately 7.1 grams of $FeCl_2 \cdot 4H_2O$ is dissolved in sufficient distilled water to produce about 25 cc. of solution having a ph of about 1.9.

b. About 100 grams of carrier metal particles which are composed of titanium which are sized so that they pass through a 65 U.S. mesh are mixed with the ferrous chloride solution.

c. The water is removed from the mixture by heating to a temperature of from about 240°F to about 300°F until a dry appearing material is obtained.

d. The resultant mass of ferrous chloride coated titanium particles is crushed so that all particles pass through a 60 U.S. mesh screen.

e. About 100 grams of ferrous chloride coated titanium particles are mixed with about 900 grams of pure titanium particles.

f. This mixture is then compacted in a suitable mold.

g. The resultant densified article is heated in a vacuum for about 2 hours to produce a sintered article.

h. The resultant, cooled article consisted of about 0.2 weight per cent iron, about 99.8 weight per cent titanium.

In another embodiment of the invention, finely divided iron particles are deposited on particles of a pre-alloyed material which is then mixed with titanium base particles. This mixture is then formed into the desired shape and vacuum sintered.

A specific example of this aspect of the invention is set forth in Example II below.

Example II

A ductile, high tensile strength titanium base article is produced as follows:

a. Approximately 7.1 grams of $FeCl_2 \cdot 4H_2O$ is dissolved in sufficient distilled water to produce about 25 cc. of solution having a ph of about 1.9.

b. About 100 grams of pre-alloyed metal particles composed of a 60 Al/40V and size such that they pass through a 65 U.S. mesh screen are mixed with the ferrous chloride solution.

c. The water is removed from the mixture by heating to a temperature ranging from about 240°F to about 300°F until a dry appearing material is obtained.

d. The resultant mass of ferrous chloride coated 60 Al/40V pre-alloyed metal particles is crushed so that all particles pass through a 60 U.S. mesh screen.

e. The dried and screened ferrous chloride coated pre-alloyed metal particles are heated in a hydrogen atmosphere at a temperature of about 1400°F for about 30 minutes to reduce the ferrous chloride to elemental iron particles.

f. About 100 grams of iron coated aluminum-vanadium particles are mixed with about 900 grams of pure titanium particles.

g. This mixture is then compacted in a suitable mold.

h. The resultant densified article is heated in a vacuum at a temperature ranging from about 2000°F to about 2300°F for about 2 hours to produce a sintered article.

i. The resultant, cooled article consisted of about 0.2 weight per cent iron, 89.8 weight per cent titanium, 6 weight per cent aluminum, 4 weight per cent vanadium, plus minor amounts of incidental impurities.

The following table illustrates the benefits derived from the practice of the instant invention.

TABLE 1

| SAMPLE NO. | APPROXIMATE CHEMICAL COMPOSITION of ARTICLE | WEIGHT PERCENT OF ADDED FINELY DIVIDED IRON | TENSILE STRENGTH p. s. i. | ELONGATION (% in 1.0 inch gage length) | SINTERED DENSITY (% of theoretical) |
|---|---|---|---|---|---|
| 1 | Commercially Pure Ti | — | 51,745 | 22.0 | 95.5 |
| 2 | Commercially Pure Ti plus added Fe | 0.2 | 55,441 | 41.9 | 96.7 |
| 3 | 6Al/4V-Ti Alloy | — | 112,423 | 9.0 | 95.8 |
| 4 | 6Al/4V-Ti Alloy plus added Fe | 0.2 | 124,236 | 13.0 | 98.5 |

From the foregoing table, it is noted that articles produced in accordance with the teachings of the present invention exhibit superior physical properties, such as a high tensile strength, close to theoretical apparent density and good ductility. These improved properties render such material well suited for use in industry, especially in the aerospace industry where high strength, low mass materials are most desired.

In addition, it should also be noted from the data presented in the foregoing table that material produced according to the present invention evidences a greater degree of ductility than similar material which was not so-treated. This increase in ductility makes it possible for one to easily forge finished or nearly finished shapes or articles from rough formed pre-forms.

While there have been described what are at present considered to be the preferred embodiments of this invention, it will be obvious to those skilled in the art that various changes and modifications may be made therein without departing from the spirit and scope of the invention as hereinafter claimed.

What is claimed is:

1. The method of producing a sintered titanium base article comprising the steps of:

coating particles of an aluminum base pre-alloyed metal with an iron containing compound capable of yielding elemental iron particles;

converting said iron containing compound to elemental iron particles at least some of which coat said pre-alloyed metal particles;

mixing said pre-alloyed metal particles and iron particles with titanium base particles;

compacting the resultant mixture into an article having the desired configuration;

heating said formed article under vacuum conditions to a temperature sufficient to cause the constituent particle thereof to diffuse together;

and cooling said article to produce a solidified, sintered article.

2. The method of claim 1 wherein said pre-alloyed material is composed of an alloy selected from the group consisting of aluminum-vanadium alloys, aluminum-tin alloys and mixtures thereof.

3. The method of claim 2 wherein said pre-alloyed material consists of 60 weight per cent aluminum and 40 weight per cent vanadium.

4. The method of claim 1 wherein said iron containing compound is selected from the group consisting of ferrous chloride, ferric chloride and mixtures thereof.

5. The method of claim 4 wherein said iron containing compound is ferrous chloride.

6. The method of claim 1 wherein said iron containing compound is converted to elemental iron particles by heating said coated pre-alloyed particles in a reducing atmosphere to a temperature sufficient to cause said reduction to occur.

7. The method of claim 6 wherein said iron containing compound is converted to iron particles by heating so-coated particles of a pre-alloyed material in a hydrogen atmosphere at a temperature of about 1400°F for a period of about one-half hour.

8. The method of claim 1 wherein said titanium base particles are composed of essentially pure titanium plus incidental impurities.

9. A method of producing a sintered titanium base article comprising the steps of:

coating a plurality of carrier metal particles with an iron containing compound which is capable of being converted to finely divided particles of elemental iron;

mixing said coated carrier metal particles with titanium base particles;

compacting the resultant mixture into an article having the desired configuration;

heating said article under vacuum conditions to a temperature sufficient to convert said iron containing compound to elemental iron particles and cause the constituent materials of said article to diffuse together;

and cooling said article to produce a sintered article.

10. The method of claim 9 wherein said carrier metal particles are composed of a metal selected from the group consisting of titanium, aluminum and mixtures thereof.

11. The method of claim 9 wherein said carrier metal particles are composed of an alloy selected from the group consisting of aluminum-vanadium alloys, aluminum-tin alloys and mixtures thereof.

12. The method of claim 9 wherein said iron containing compound is selected from the group consisting of ferrous chloride, ferric chloride and mixtures thereof.

13. The method of claim 12 wherein said iron containing compound is ferrous chloride.

14. The method of claim 9 wherein said titanium base particles consist essentially of pure titanium plus incidental impurities.

15. A method of producing a sintered titanium base article comprising the steps of:

coating a plurality of metal particles with an iron containing compound which is capable of being converted to finely divided particles of elemental iron;

mixing said coated metal particles with titanium base particles; and forming the resultant mixture into a compacted article having the desired configuration by the application of suitable pressure at a suitable temperature.

* * * * *